US006020658A

United States Patent [19]

Woodhead et al.

[11] Patent Number: 6,020,658

[45] Date of Patent: Feb. 1, 2000

[54] ELECTRIC FENCE ENERGIZER

[75] Inventors: Robert Charles Bryan Woodhead, Cockle Bay; John Talbot Boys, Birkdale; Andrew William Green, Papatoetoe, all of New Zealand

[73] Assignee: Stafix Electric Fencing Ltd., Auckland, New Zealand

[21] Appl. No.: 08/952,053

[22] PCT Filed: May 10, 1996

[86] PCT No.: PCT/NZ96/00040

§ 371 Date: Nov. 10, 1997

§ 102(e) Date: Nov. 10, 1997

[87] PCT Pub. No.: WO96/36203

PCT Pub. Date: Nov. 14, 1996

[30] Foreign Application Priority Data

May 12, 1995 [NZ] New Zealand ..... 272112

[51] Int. Cl.[7] ..... H05C 1/04

[52] U.S. Cl. ..... 307/106; 307/108; 256/10; 340/564; 361/232

[58] Field of Search ..... 307/106, 107, 307/108, 96, 132 R; 340/564; 361/232; 256/10

[56] References Cited

U.S. PATENT DOCUMENTS

| | | | |
|---|---|---|---|
| 4,114,185 | 9/1978 | Gallagher | 361/232 |
| 4,394,583 | 7/1983 | Standing | 307/108 |
| 4,396,879 | 8/1983 | Weinreich et al. | 320/1 |
| 4,443,839 | 4/1984 | Onodera et al. | 363/20 |
| 4,561,046 | 12/1985 | Kuster | 363/21 |
| 4,565,931 | 1/1986 | Fumey | 307/262 |
| 4,605,999 | 8/1986 | Bowman et al. | 363/19 |
| 4,675,796 | 6/1987 | Gautherin et al. | 363/20 |
| 4,757,433 | 7/1988 | Santelmann, Jr. | 363/19 |
| 4,859,868 | 8/1989 | McKissack | 256/10 |
| 5,381,298 | 1/1995 | Shaw et al. | 361/232 |
| 5,514,919 | 5/1996 | Walley | 361/232 |
| 5,550,530 | 8/1996 | Hamm | 307/106 |
| 5,767,592 | 6/1998 | Boys et al. | 307/108 |

FOREIGN PATENT DOCUMENTS

| | | |
|---|---|---|
| 286080 | 2/1996 | New Zealand . |
| 493016 | 2/1976 | U.S.S.R. . |
| 729369 | 5/1980 | U.S.S.R. . |
| 1705916 | 1/1992 | U.S.S.R. . |
| 2 261 779 | 5/1993 | United Kingdom . |
| 2 299 471 | 6/1998 | United Kingdom . |

*Primary Examiner*—Albert W. Paladini
*Attorney, Agent, or Firm*—Young & Thompson

[57] ABSTRACT

An energy-efficient energizer for an electric fence for controlling livestock or the like, includes an output voltage sensor. By switching to extra storage capacitance and/or altering the charge voltage the energizer varies the duration of the output pulse and perhaps also the pulse voltage according to the sensed output, thus maintaining an effective livestock barrier and consuming high power only when required. Output pulses are about 8 kV (no load) down to 4 kV (wide range of loads). The control algorithm determines the capacitor charging time and initiates a charge sooner if a higher power pulse is to be delivered, so maintaining a constant pulse rate. The energizer includes a 12V DC power option and has a circuit for synthesizing a substantially unipolar pulse having low harmonic content.

14 Claims, 9 Drawing Sheets

ELECTRIC FENCE ENERGIZER

FIELD OF THE INVENTION

This invention relates to the field of generation of high-voltage pulses of controlled shape; more particularly to electric fence energisers, and specifically to energisers capable of adapting to a sensed load and optimised in order to operate economically as from batteries.

BACKGROUND

Invention of safe electric fences has permitted farmers over many years to control the movement of livestock around a farm with "variable geometry fencing" which, being light and requiring no great physical strength, can be moved easily, so considerably improving the efficiency of grasslands farming.

While many fences are powered from the mains, it is often an advantage to have a locally driven fence far from a source of mains power. Batteries, windmills, or solar generators are typically used as an energy source, including battery backup in most cases. There is a need for an effective fence energiser that draws a minimal amount of current from a battery supply, in order to conserve consumption and minimise the size of the generator and battery bank used to power the system.

Furthermore, designers of mains-powered energisers have found difficulty in dissipating heat from within a lightly loaded circuit inside a compact enclosure because if the energiser is in a lightly loaded state more of the pulse energy is dissipated within the box. If the circuit can alter its stored charge in accordance with the immediate requirement, it should dissipate a smaller amount of excess energy within its own components, rather than deliver the energy to the fence.

SUMMARY OF THE INVENTION

It is an object of the present invention to provide an improved electric fence energiser, or one which will at least provide the public with a useful choice.

In a board aspect the invention provides a pulse generator in which a series of separated pulses each having a substantially unipolar pulse shape or profile are produced by a process of transferring electrical energy out of storage in a first capacitative storage through an inductor and into a second capacitative storage in parallel with a primary winding of an output transformer to generate transformed pulses at an output connected to a secondary winding. The pulse generator selects one power mode from a selection of power modes, and is capable of altering the power of an output pulse by varying its duration yet retaining the substantially unipolar profile. To this end, the invention includes additional capacitative storage, and an additional indicator which are capable of being included in or excluded from the circuit of the pulse generator.

BRIEF DESCRIPTION OF THE DRAWINGS

The following is a description of a preferred form of the invention, given by way of example only, with reference to the accompanying diagrams.

DESCRIPTION OF PREFERRED EMBODIMENTS

General

This invention comprises means to generate an electrical impulse of comparatively high power, brief duration, and having a controlled, substantially unipolar waveform of the raised cosine shape (also referred to as the "Cyclic Wave™ shape), wherein the invention includes a facility to raise or lower the power of the impulse in accordance with the current drawn. Although there are many applications for such an impulse generator, a particularly attractive commercial application is as an energiser for an electric fence on a farm where impulses separated by about 1 second, having an energy of about 6 joules, a peak voltage of the order of 5 kV, and a duration of about 100 microseconds are considered suitable. Low radiation of radio-frequency interference (RFI) from harmonics is desirable and often imposed as a legal requirement, for the pulse is in effect coupled to a large antenna (the fence system).

Figure 10:
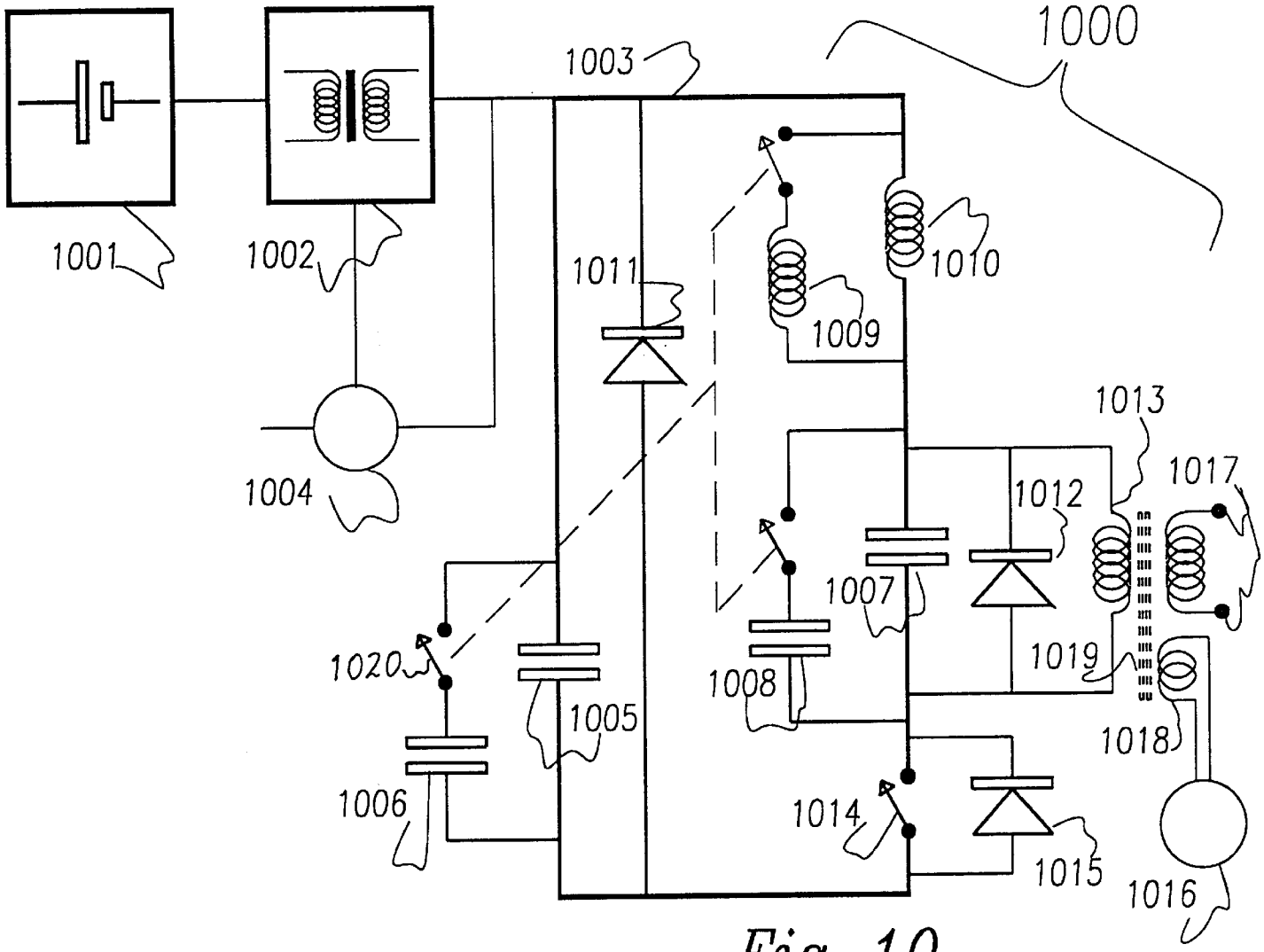
FIG. 10: is a block diagram of the invention.

FIG. 10 illustrates the invention 1000 in principle, although not in detail, and linkages between measurement symbols and possible control points are not shown. These are given elsewhere. The box 1001 represents an energy source, such as a mains electricity supply, solar cells, or batteries—or a combination of sources. 1002 represents a voltage step-up converter to produce DC at perhaps 600–800 V and pass it to the DC bus 1003. The converter can be controlled, such as to stop when the bus voltage on 1003 reaches a desired value. (1004 indicates a feedback loop including means for comparison between a reference and a voltage derived from 1003; the active bus).

Figure 6:
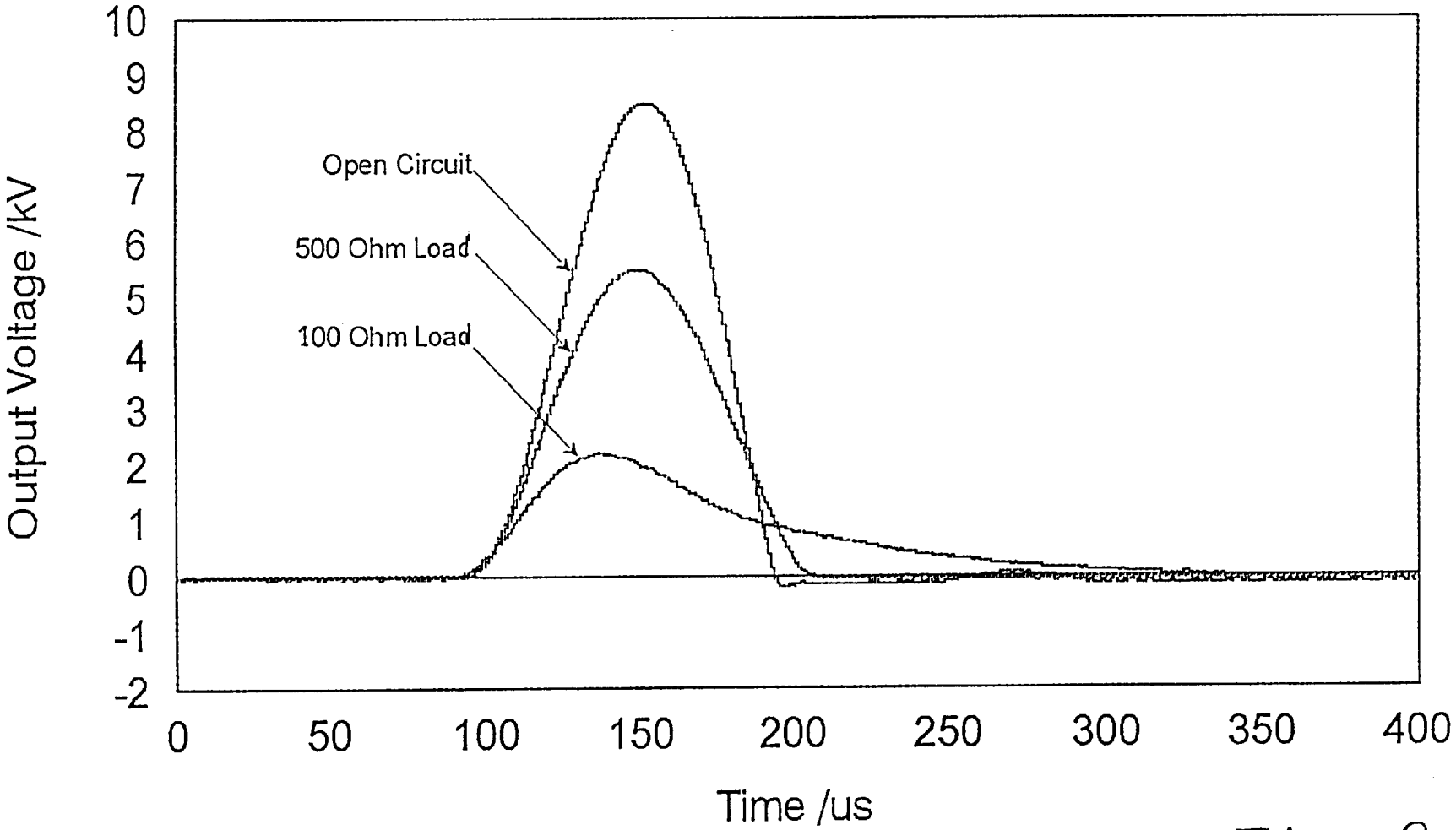
FIG. 6: is an illustration of pulse shapes from the energiser of the present invention—in economy mode operation.
Figure 7:
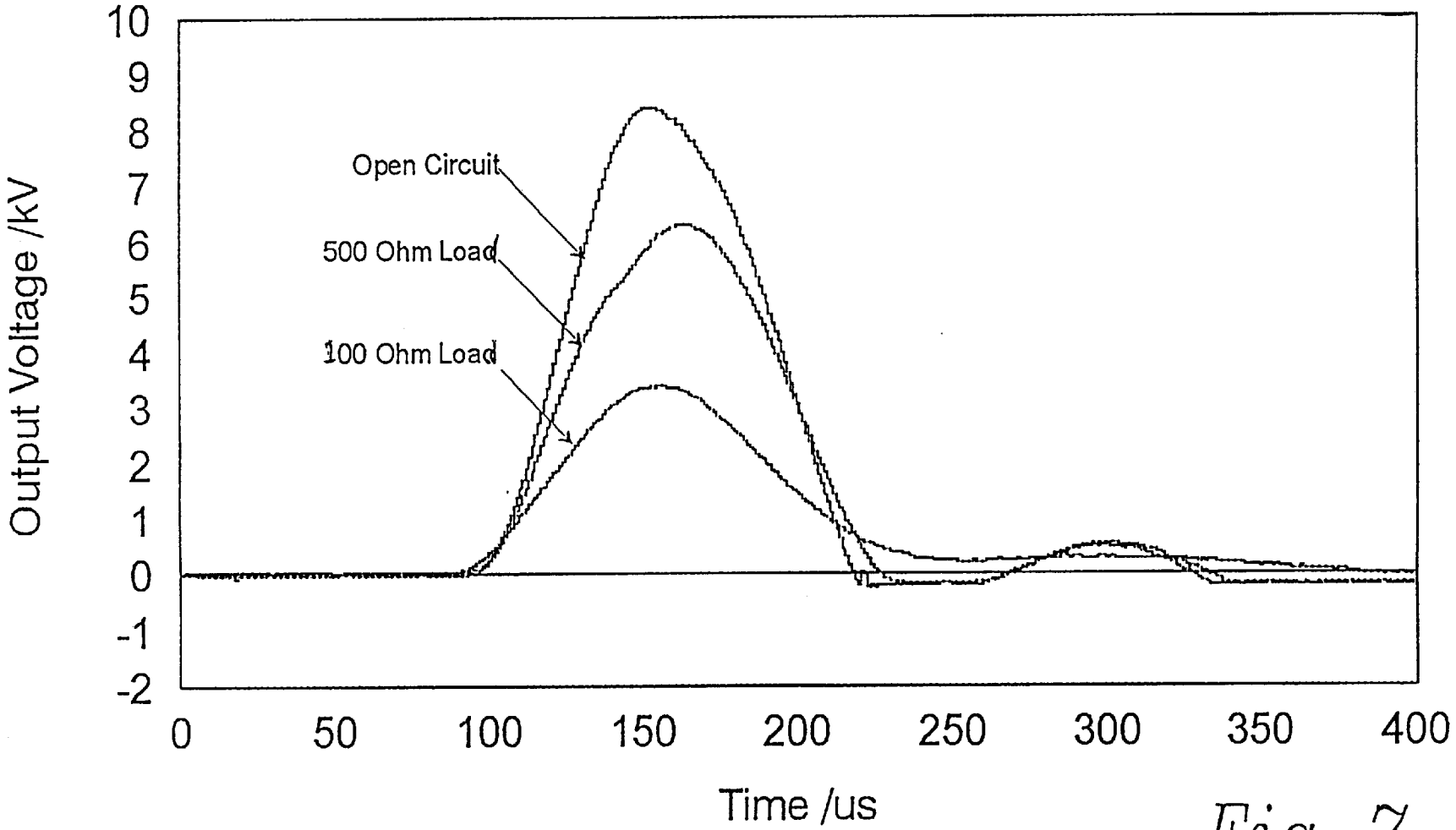
FIG. 7: is an illustration of pulse shapes from the energiser of the present invention—in full mode operation.
Figure 8:
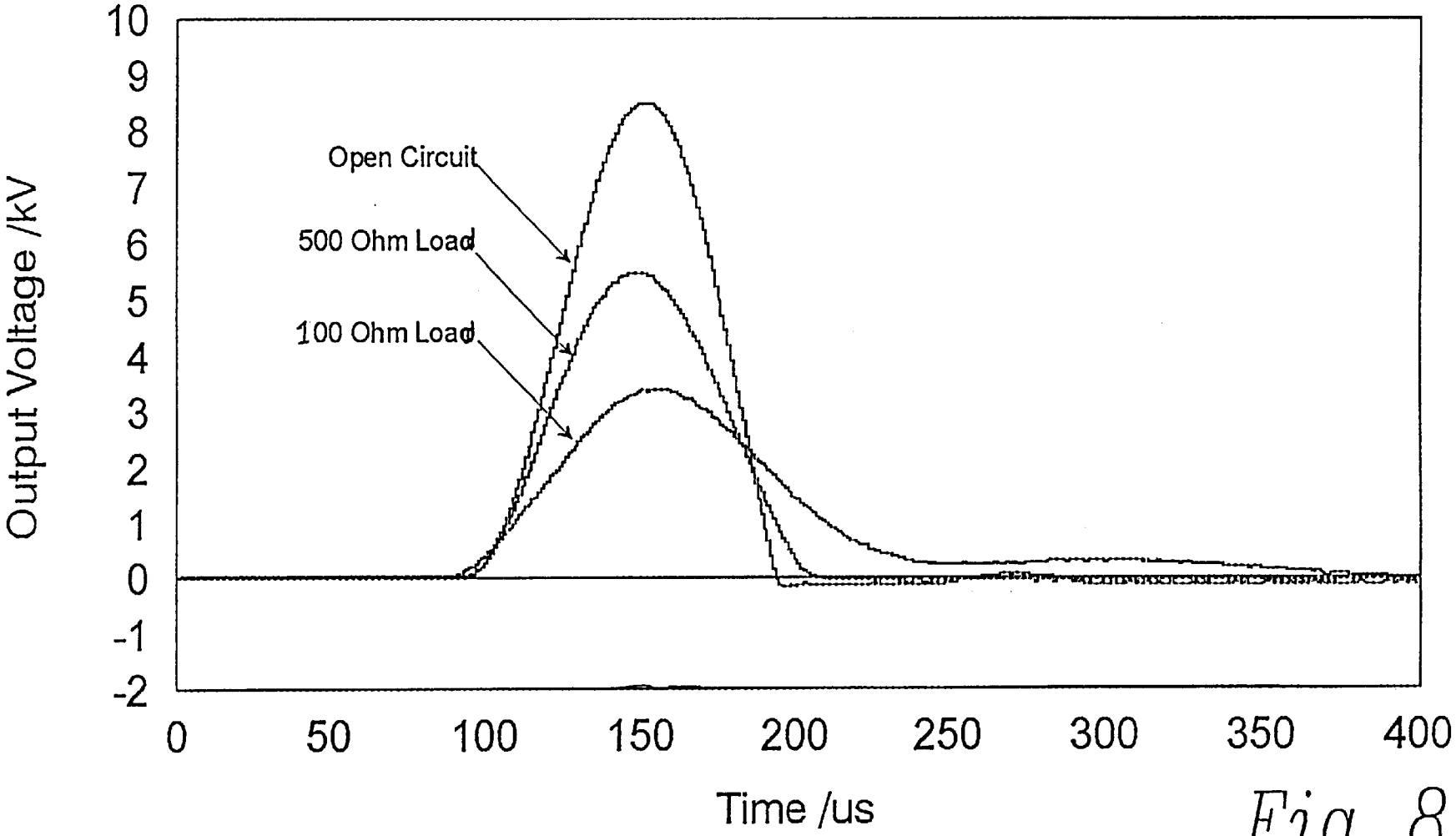
FIG. 8: is an illustration of pulse shapes from the energiser of the present invention—in automatic mode operation.

The capacitors 1005 and (in a higher power mode, 1006 as well but for this description we shall assume that the ganged power mode switch 1020 is open) are an energy storage module, storing the charge to be used in energising the fence. When an output pulse is required, the pulse release switch 1014 is closed and energy flows from the energy storage circuit into the components of the "Cyclic Wave™" timing circuit, including inductor 1010 (optionally with inductor 1009) and capacitor 1007 (optionally with capacitor 1008). As voltage builds up across capacitor 1007, energy is transferred to the primary winding 1013 and so to the iron-dust core 1019 and secondary winding of a high voltage step-up transformer. Transformer action causes the voltage across capacitor 1007 to appear amplified at the transformer secondary and is connected to the fence at the outputs 1017. Typical waveforms are illustrated in FIGS. 6, 7, and 8. Meanwhile a sensor of transformer flux—the coil 1018 obtains an indication—more precisely a voltage integral—of the voltage developed by this pulse generator.

The actual LC timing of the voltage buildup on the capacitor 1007 is calculated from the value of 1007 in series with capacitor 1005 and inductor 1010. For nominal fence loads, the inductance of the output transformer is of the order of ten times the inductance of 1010. The transformer has only a small effect on pulse timing.

The first positive part of the voltage-time trace observed across capacitor 1007 is essentially sinusoidal and without lingering harmonics. This part of the voltage pulse is used as the pulse sent to the electric fence system around the farm, and provides effective stock control while producing a minimum amount of radio frequency interference (RFI). The diode 1012 is used to catch and clamp the negative voltage appearing across capacitor 1007 and thus remove any negative part of the pulse voltage from the fence system. Energy circulates around the circuit comprising 1005, 1007, 1011, 1012, the output transformer, and 1015 until it is dissipated in resistive elements such as in the primary turns 1013 of the output transformer, the core 1019 of which will by that time have fallen into saturation.

If the ganged switch 1020 of FIG. 10 is now closed, the same principle of operation is exhibited but the values of the storage capacitor (1005, 1006) has now risen and the time constants of the circuit have been altered by adding a series inductance 1009 and a series capacitance 1008. With suitably selected values, the result of closure of the switch 1020 is to increase the duration of the output pulse while maintaining substantially the same output voltage or amplitude. If the value of 1005 is equal to the value of 1006, the energy in the output pulse is doubled.

Advantages of using this switched capacitor and switched time constant system include that it provides a useful means for controlling the input power consumption to suit the output energy requirements of the fence system by pulse width control only, while similar voltage levels are maintained, and at the same time the "Cyclic Wave™" principle of operation is retained. It is rather difficult to achieve the same result by varying the DC bus voltage (at 1003) as in the prior art.

Energy not utilised by the fence system is converted to heat within resistive components. Use of a lower power mode (switch 1020 open) has the effect of minimising such waste energy and so larger power outputs can be accommodated within a given size of enclosure as compared to an energiser without this kind of adaptability.

In the preferred version of the circuit, a single low-power semiconductor switch is used with appropriate steering diodes in order to replace the ganged switch 1020.

Capacitor sizes discussed above are purely illustrative ratios, and more than one step of power delivery increment may be provided. The example unit (see below) switches between Cx and 2Cx.

EXAMPLE

This example unit is an assembly accepting a nominal 12V DC supply (though the actual supply voltage may be varied over a range of from 8.5 to 20V, and over a larger range if some component values are adjusted) and providing a series of substantially unidirectional high-voltage pulses (typically 8 kV) at a light load, and maintaining the output voltage at above 4 kV over a wide range of loads including the range to be expected during normal use of an electric fence energiser. Its energy is nominally 6 Joules.

In general, this energiser resembles other energisers in that it charges one or more capacitors to a high voltage over a reasonable time, then rapidly discharges the charge through preferably a high-frequency transformer which steps up the voltage into a pulse of the desired magnitude. Like some but not all other energisers, the capacitors are charged immediately before a pulse and discharged at the moment that their charge reaches a target voltage.

The contents of the "black box" differ from that of much earlier energisers in several ways.

(1) It includes the interference-minimising strategy of U.S. Pat. No. 5,767,592, which is hereby incorporated by way of reference—in which an exchange of charge from one capacitor to another, via an inductor, results in a raised cosine waveform being generated. This waveform has a minimal content of harmonics. This strategy is preferable to the prior-art practice of first generating a pulse having a high content of harmonics and then to filter them out, at a high power level.

(2) It possesses a powdered-iron or iron-dust cored output transformer—which is a relatively cheap high-frequency transformer having acceptable fidelity of response at the frequency and power levels involved. We provide a sensor of magnetic flux as a reliable, electrically isolated way of determining the load on the output. A suitable sensor might be a Hall effect module, a magnetoresistive sensor, or simply a few turns of wire.

The iron-dust output transformer has a turns ratio giving it a voltage step-up ratio of from 9 to 12, providing about 8 kV output under open-circuit conditions. The iron dust transformer can act as a saturating inductor in order to trap the circulating electric energy at the end of the pulse and dissipate it. Surprisingly, its saturation seems to occur only at the end of the delivered pulse.

The output voltage sensing means comprises a separate winding of about a turn wrapped around or within the primary winding. This comprises a transducer of output voltage.

(3) It possesses a sequencer—generally a microprocessor, that among other functions determines the sequences of charging and discharging, and interval timing, and adds certain safety limitations. The microprocessor will control the different operating modes of the energiser. They are known as "Economy" mode, "Full" mode and "Automatic" mode. In the "Economy" mode, a small capacitor bank is used. In the "Full" mode a larger bank (which may include the small bank) is used, and in the "Automatic" mode the device can select for itself the bank that is used.

In "Economy" mode, only a single storage capacitor is charged up to a fixed voltage. The energiser produces the lowest energy pulses compared to other two operating modes, but consumes the least battery energy. FIG. 6 illustrates sampling oscilloscope outputs from a 6 Joule electric fence energiser according to this invention in "economy" mode, at three loads; zero, 500 ohms, and 100 ohms. The vertical axis is kilovolts, and the horizontal axis is time.

In "Full" mode, all storage capacitors are charged up to a fixed value, and the energiser will produce the most powerful output pulses. However, note that in this mode the energiser consumes the highest battery energy. FIG. 7 illustrates sampling oscilloscope outputs from a 6 Joule electric fence energiser according to this invention running at full power and at three loads as above.

In "Automatic" mode, the storage energy is controlled automatically by switching additional storage capacitors and by controlling the charge voltage. FIG. 8 illustrates sampling oscilloscope outputs from a 6 Joule electric fence energiser according to this invention in "Automatic" mode, at three loads as above. Note that in comparison to FIG. 6, the pulse height is almost double, and the pulse duration is extended for the highest loaded waveform.

The strategy is to maintain an effective fence voltage, but at the same time use as little energy as possible from the battery. The energiser starts off in the most economic mode with a lightly loaded fence. As the fence load increases, the output voltage falls towards a lower level (about 4 kV) at which time additional storage capacitance is "switched in" and the voltage point at which capacitor discharge occurs is adjusted so as to maintain the output voltage. In addition, if the output voltage drops suddenly due to contact by livestock, capacitors are "switched in" immediately and charged fully to produce the most powerful pulse to shock animals. After a few pulses and removal of the sudden load, the output pulses will revert to the normal level.

A C/2C configuration would normally consume about one half the current required to adequately control livestock, unless there are frequent challenges to the integrity of the fence (or if the fence is poorly insulated), because it normally charges and discharges only the single unit of C. Thus the fence conserves battery power.

Technical Details

Note that the parts labels on the various Figures should be taken in isolation; that is, each Figure may have a different Q1 or a different R1.

Figure 1:
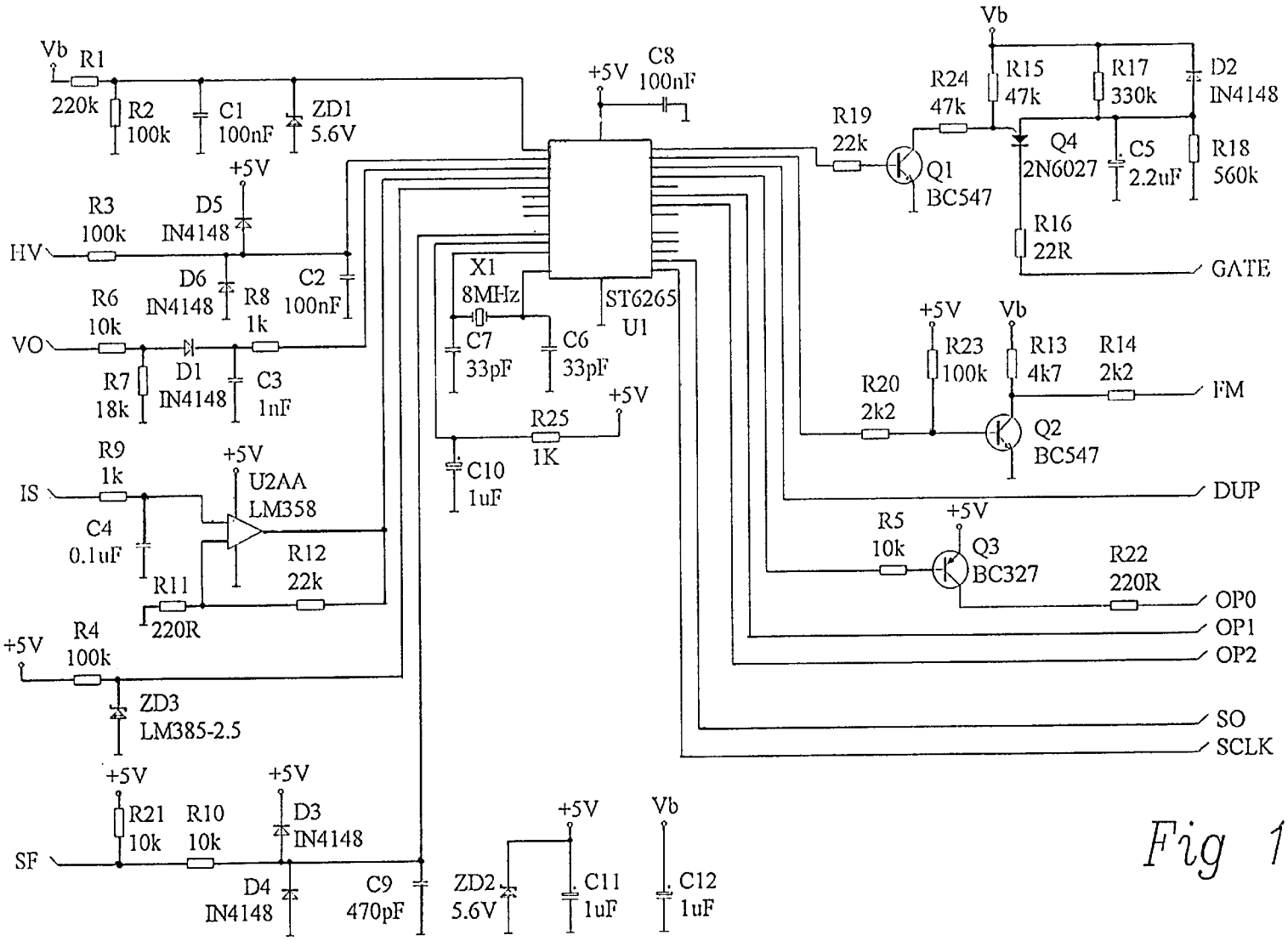
FIG. 1: is an illustration of a circuit diagram of the control card (carrying a microprocessor) of the preferred embodiment of the invention.

FIG. 1 shows a circuit diagram for a control board carrying a microprocessor U1 type ST6265 which includes analog-to-digital inputs, program storage and data random-access memory. Inputs along the left side of FIG. 1 include HV which measures the charge voltage on the storage capacitor(s), (see FIG. 2) IS for sensing the flyback converter function, VO for sensing transformer flux, and SF for sensing whether the SCR Q3 of FIG. 2 has fired or not. Other inputs include an array of jumpers (not shown) which may be shorted or left open to select options within the stored program for, for example, different powers of main circuit or different types of function as required for sale to various countries. The outputs at the right of the circuit include a transistor current buffer, Q1 with Q4, which drives the gate of the SCR, Q3 on FIG. 2. OP0, OP1, OP2 and OP3 connect with the control switch circuit of FIGS. 4 and 9. Lines SO and SCLK are serial digital communications lines according to the well-known $I^2C$ bus.

Figure 3:
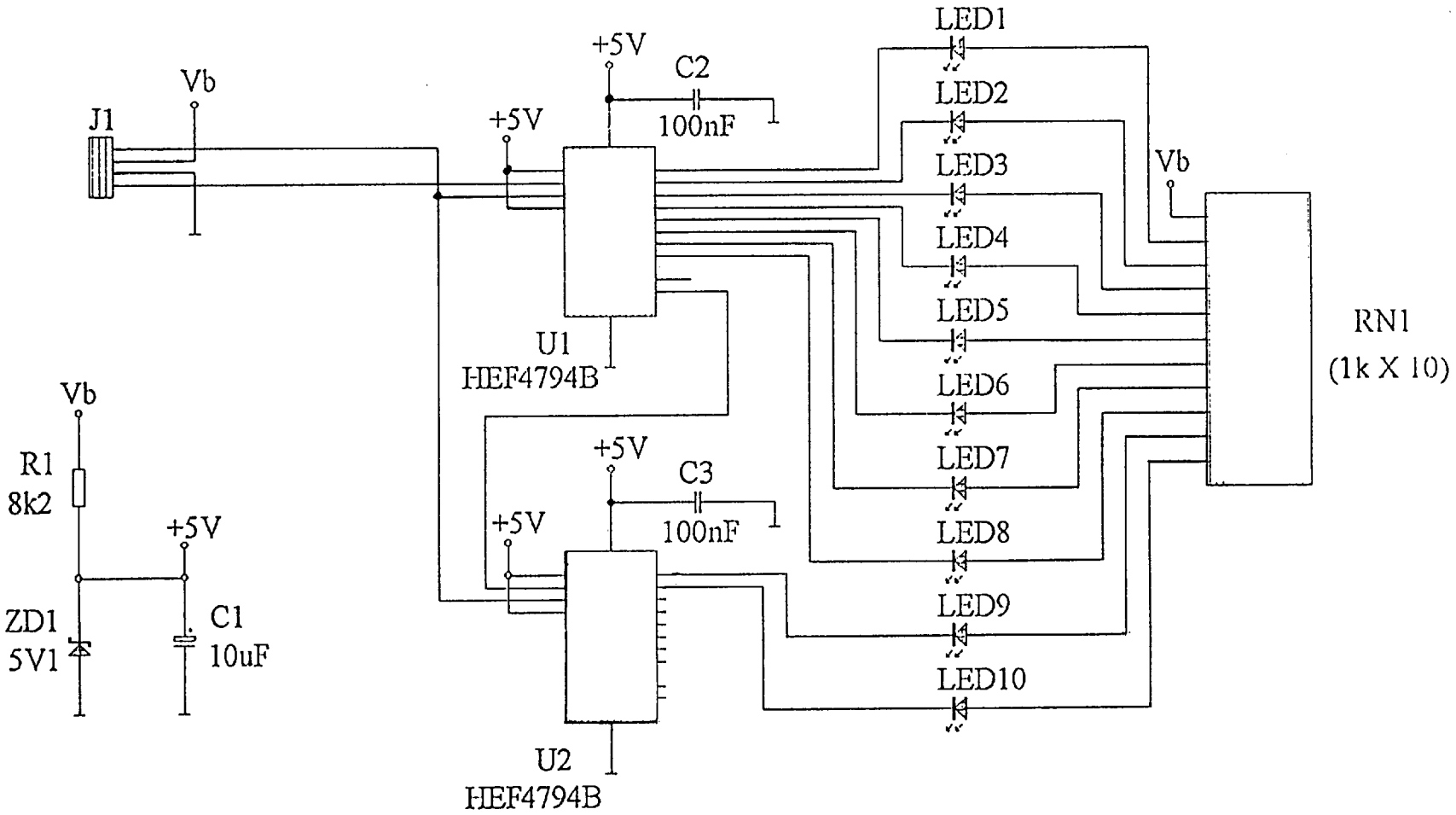
FIG. 3: is an illustration of a circuit diagram of the output pulse strength indicator of the preferred embodiment of the invention.
Figure 5:
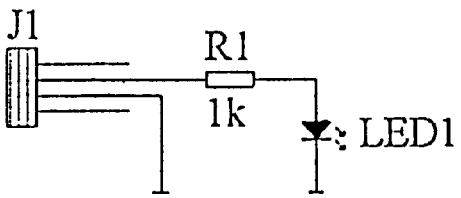
FIG. 5: is an illustration of a circuit diagram of the power indicator of the preferred embodiment of the invention.

FIG. 3 is simply means to indicate to a user, by means of an array of light emitting diodes, LED1 to LED10, the approximate strength of the output pulse. The information is supplied from the microprocessor in a serial digital form on lines SO and SCLK.

Figure 2:
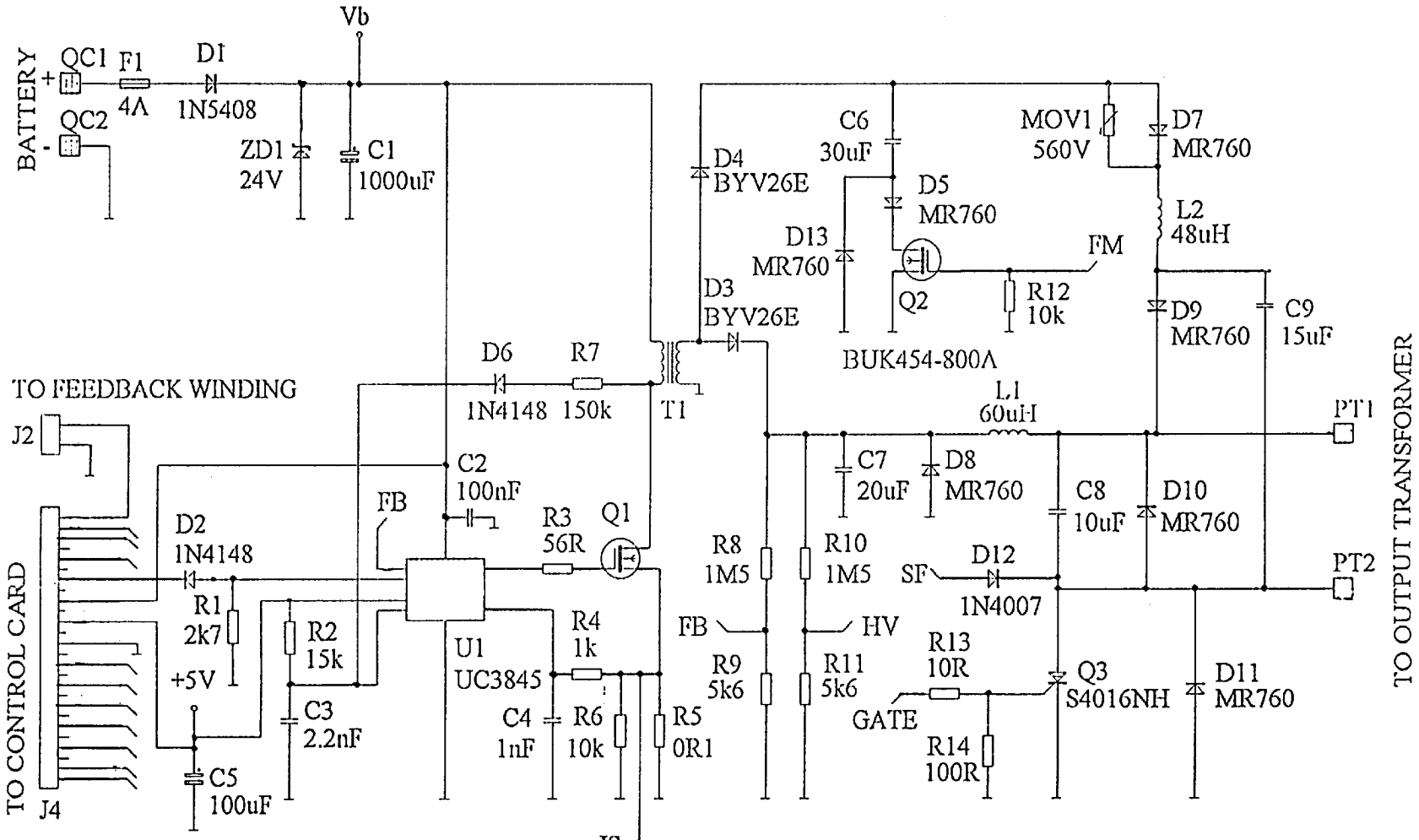
FIG. 2: is an illustration of a circuit diagram of the main module of the preferred embodiment of the invention.

At top left of FIG. 2 we show means to import a DC battery voltage of between 8.5 and 24 volts, and convert and rectify it into a DC bus voltage at the output of T1 after rectification having an maximum output of about 650V. While this circuit is a battery powered device, it will be evident to one skilled in the art that a mains-powered electric fence energiser can be provided by either (a) supplying a low-voltage DC input as from an external AC-driven battery charger or (b) replacing the DC circuitry with an AC-driven power supply. The alternative supply will include an enabling control line, for charge control purposes. Because of the possibility of using a directly coupled battery charger, we have provided for isolation of the high voltage side so that there is no direct connection between the grounds at the input and the grounds at the output, despite the use of similar symbols on the circuit diagram. (Purely battery-driven electric fence energisers need no such isolation.)

The raised DC voltage used to charge the capacitors for energy pulses comprises the device U1—a UC 3845 current-mode pulse-width-modulator controller, here used to control a flyback dc-dc converter operating in a voltage step-up mode. MOSFET transistor Q1 (type Philips BUK452-60A or equivalent) carries out the power interruption switching function, and U1 may be enabled or disabled.

In order to satisfy a need for an at least partially regulated output voltage, we provide an ability to vary the charge voltage at which discharge occurs. We have found this to be a more economical way of fine-tuning the output power than providing more banks of switchable capacitors, and it provides a means to regulate the output voltage so that it remains above 4 KV over a wide range of loads likely to be encountered when in use. Excessive loads will cause a reduction in voltage.

The DC voltage from T1 via D3 charges C7 (20 $\mu$F), and should switch Q2 be ON, also C6 (30 $\mu$F) for a total of 50 $\mu$F. C7 corresponds to the "economy" mode and C6+C7 corresponds to the "Full" mode. This use of switched capacitors as energy sources for the fence output is however rendered more complex by the remainder of the circuitry that generates a raised cosine waveform, having a minimal harmonic content, as described in the above-noted U.S. Pat. No. 5,767,592.

In this type of circuit the discharge pulse is shaped by:

(a) a rising phase wherein a series inductance (a timing inductor) limits the initiation of a rising phase, while the current is flowing through the output transformer,
(b) until a second or timing capacitor having (in our example) about half the capacity of the storage capacitor becomes charged, limiting the rise of the pulse,
(c) then the pulse starts to decay as the second capacitor commences discharge through a timing inductor,
(d) and finally the flow of current dies down, as a result of entrapment within a saturable inductor or other switching device.

Resulting pulses are best described as raised cosine waveforms and a number of examples taken from a prototype circuit are shown in FIGS. 6, 7 and 8.

Economy Mode

In the circuit of FIG. 2, the economy mode can be considered as not involving that part of the circuit above the trace including inductor L1, for that part is floating as long as switch Q2 remains open. The economy mode involves C7, charged through T1 point at which the microprocessor has determined that charging shall occur. At the point of discharge, set by sensing the charge voltage, switch Q3 (SCR type S4016NH) is closed by the application of gate current at "GATE", thereby effectively grounding connector PT2, the earthy side of the output transformer primary winding (herein called PW). Current then flows from C7 through PW, and its rate of rise is limited by the 60 $\mu$H timing inductor L1. Charge has by then been transferred to and stored within the economy mode timing capacitor C8 (10 $\mu$F). As this charge proceeds to dissipate through PW, the falling portion of the output pulse is generated.

Full Mode

Again using the circuit of FIG. 2, operation of the full mode can be considered as involving that part of the circuit including and below the trace including inductor L1 (for which the above explanation continues to apply), as well as that part which is above. A number of steering diodes assist in the operation of this circuit.

Switch Q2 is closed during charging, so loading C6 with charge. On discharge the diode D13 carries the discharge current. Both C7 and C6 are charged through T1 when the microprocessor has determined that charging shall occur. At the point of discharge, switch Q3 (SCR type S4016NH) is closed by the application of gate current at "GATE", thereby effectively grounding connector PT2, the earthy side of the output transformer primary winding (herein called PW).

Current additional to that from C7 then flows from C6 through PW, and its rate of rise is limited by the 48 $\mu$H timing inductor L2. (The steering diode D7 with protective surge arrestor MOV1 may be replaced by one or more fast-recovery diodes in parallel). The full mode timing capacitor C9 is included within the circuit in this mode by diode D9. As before, once charge has been transferred to C9 it is dissipated. Other diodes are current steering diodes.

The output waveforms shown in FIGS. 6 to 8 illustrate occasional "humps" or small secondary pulses. These originate in imperfectly matched pairs of timing capacitor/inductor groups, and can be effectively minimised by suitable component matching. It appears that "matching" in this instance comprises having the timing period of one pair extending beyond the timing period of the other.

Figure 4:
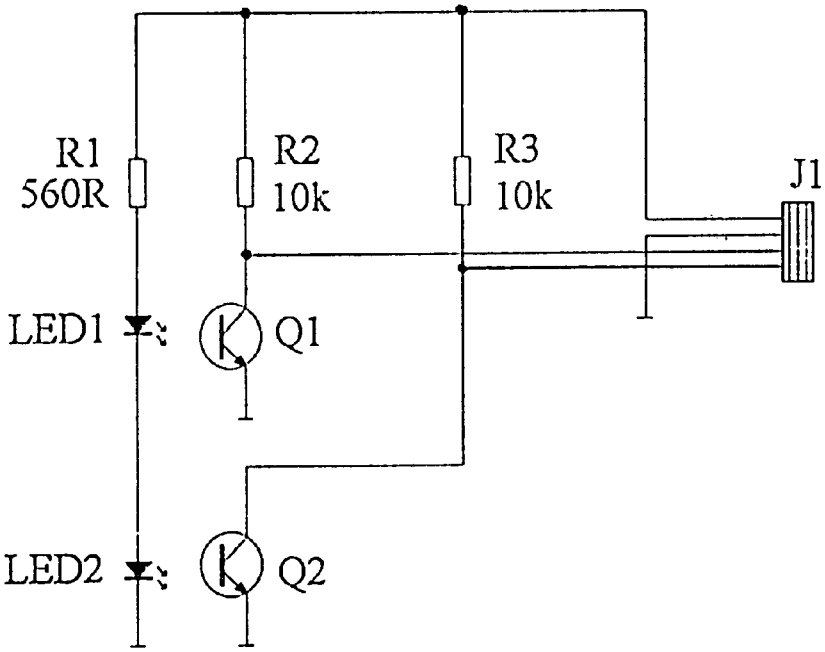
FIG. 4: is an illustration of a circuit diagram of the control switch array of the preferred embodiment of the invention.

The switching in of addition storage capacitors is achieved by means of a silicon-controlled rectifier or other solid-state switch. We prefer a "Power MOSFET" (Metal oxide silicon field-effect transistor) type Philips BUK 454-800 (Q2 of FIG. 2) for the purpose as it has sufficiently high capacity to handle current pulses. We have provided a user control, acting via the microprocessor on the control line FM, that allows selection of the low power "Economy" mode alone, the high power "Full" mode alone, or "Automatic" operation. (This switch is shown in FIG. 4, where a a kind of isolated switch, comprising a light blocking barrier is inserted between LED1 and phototransistor Q1, or between LED2 and Q2, or both). Mechanically, this control is adapted for safe, reliable use with wet, fat fingers; such fingers being a part of many dairy farmers.

Figure 9:
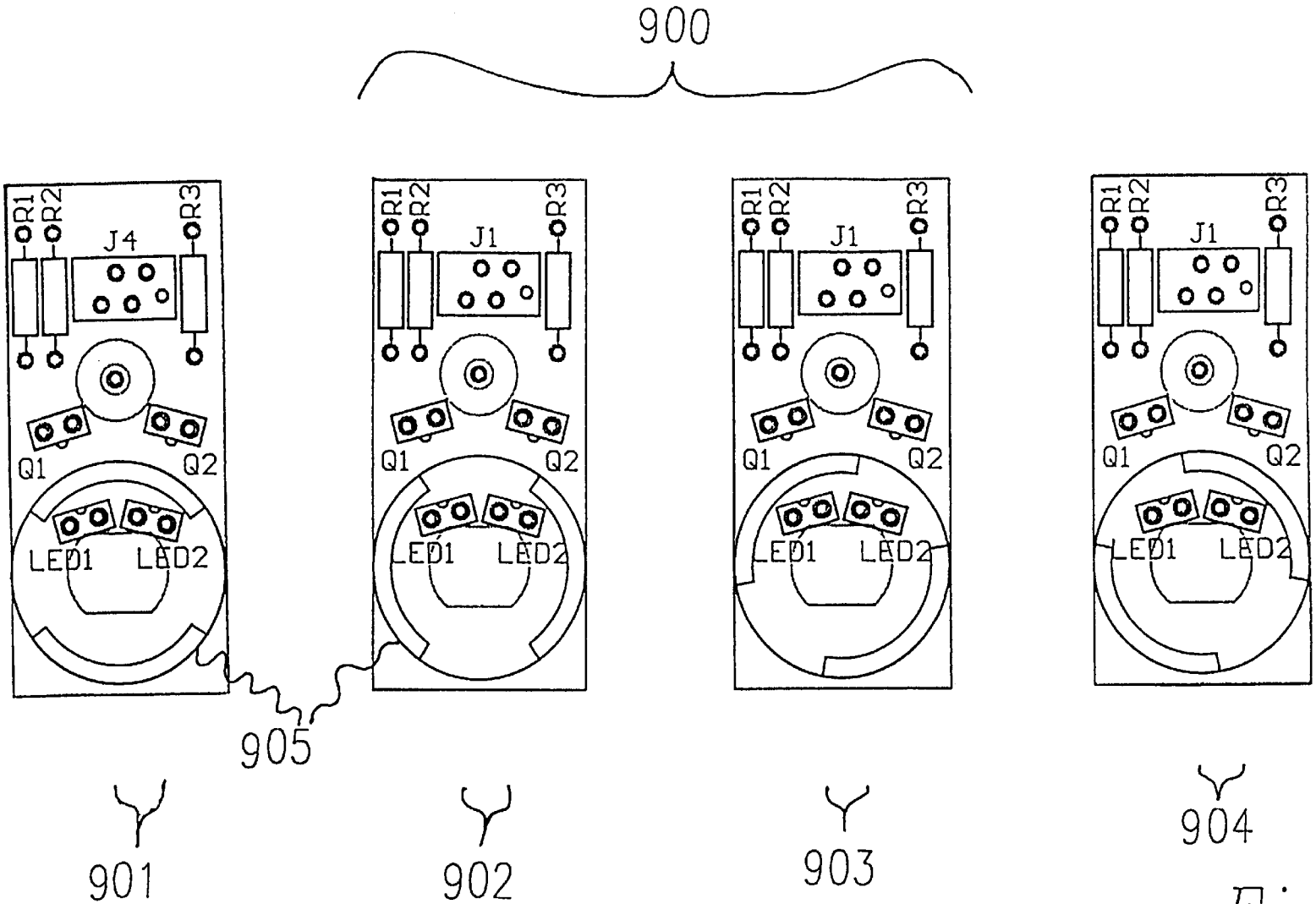
FIG. 9: is a diagram of an optically based switch in four operating modes of the invention.

FIG. 9 shows a diagram of a circuit board carrying the circuit of FIG. 4, also portraying the physical arrangement of the parts. Q1 and Q2 are phototransistors, and LED1 and LED 2 are preferably matched light-emitting diodes. The circle with sectors 905 represents the light-gate end of a control knob extending vertically from the plane of the drawing to a user control knob on the outside of the control box, which knob can be rotated through 180 degrees to cause any one mode to be entered, then repeats the sequence through the other 180 degrees, and can be continually rotated in order to select any one of four operating modes. The two sectors 905 are opaque to light. When both LED—phototransistor beams are blocked as at 901, the fence energiser is off. When both beams are open, as at 902, the controller is in its economy mode. When only the LED1-Q1 beam is blocked the controller is in its full power mode. When only the LED2-Q2 beam is blocked, the controller is in its automatic mode. The control knob passes vertically through the case and emerges through a substantially watertight seal. This circuit is connected to FIG. 1.

Although the preferred embodiment offers either C or a total of 3C it is feasible to extend this design to provide more than one choice. (See later regarding a variable discharge trigger point).

The effect of extra capacitance, in the presence of a raised load, is to provide a pulse of similar amplitude (voltage) but a longer though still defined duration. This is an advantage over previous energisers with a low-power mode for in those energisers the low power mode generally resulted in a much lower output voltage as well.

Variations

We have added means to provide a constant pulse rate at about one every 1.2 seconds by a procedure (embodied within the microprocessor operating program) of determining in advance the capacitor charging time for the capacitors known to be used in the next pulse, and initiating a charge sooner if a higher power pulse is to be delivered, so that the charge on the capacitor reaches a predetermined voltage at a substantially constant time after the previous discharge. In that way, the pulses delivered by the energiser are generated at a substantially constant rate regardless of intensity. Of course, sagging battery voltage may result in a longer charge duration, and an improvement to the microprocessor operating program comprises a factor which takes account of the supply voltage when under load.

A yet further improvement to the microprocessor operating program comprises an ability to carry out some self testing; thereby aiding in improvement of the safety aspect of the energiser of this invention. For example the microprocessor will become aware of a fault in which a pulse which was not commanded has occurred, which might happen if a silicon controlled rectifier breaks down.

The energiser includes spare random-access memory and program storage space, and we can include means to store current readings from a recent series of pulses (for example the most recent 30 pulses) in a cyclically replaceable array and compare for example the latest 5 pulses with the preceding 25. Should a step change in current be observed, this may indicate that an animal has fallen against the fence (raised current) or that a connector to a fence has come adrift (lowered current). Changes such as leakage caused by dew or rain will tend to cause more gradual changes in current drawn.

A still further improvement to the invention as described herein is to use the control of capacitor switching and maximum charge voltage values in combination with a mains-powered circuit. This has the advantage that less heat is dissipated within the energiser, especially when it is lightly loaded, so that the energiser case and at least some components can be smaller than is the case for present designs, in which the buildup of heat can be a problem. The designer needs to allow for a worst-case condition in which the energiser is substantially not loaded and the energy of each pulses is dissipated within the energiser case. This improvement would minimise the actual energy to be dissipated.

Other applications for the energiser, now considered as a power pulse generator rather than just an electric fence energiser, include sonar, vibration testing, high voltage insulation testing, and the like. As the output is controlled by various switching diodes and the like on the instrument side of the output one does not see a prolonged oscillation if the device drives a purely capacitative load—as will be seen if an old-style energiser drives a capacitative load.

Finally, it will be appreciated that various alterations and modifications may be made to the foregoing without departing from the scope of this invention as set forth in the following claims.

We claim:

1. A pulse generator comprises a circuit in which a series of separated pulses each having a substantially unipolar pulse shape or profile are produced by transferring electrical energy out of storage in a first capacitative storage means through first inductive means and into a second capacitative storage means in parallel with a primary winding of an output transformer means, so generating the separated pulses at an output connected to a secondary winding, the generator also incorporating means for charging the first capacitative storage means to a predetermined voltage, wherein the pulse generator includes selector means for selecting one power mode from a selection of power modes, the selector means being capable of altering the power of the separated pulses by varying their duration yet substantially retaining the height of the substantially unipolar profile, the selector means comprising third capacitative storage means, second inductive means, and fourth capacitative storage means, each for being selectively included in or excluded from the circuit of the pulse generator.

2. A pulse generator as claimed in claim 1, wherein said third capacitive storage means, said second inductive means, and said fourth capacitive storage means are connected in parallel, respectively, with said first capacitive storage means, said first inductive means, and said second capacitive storage means.

3. A pulse generator as claimed in claim 1, further comprising means for sensing an output voltage of the pulse generator and wherein said selector means includes or excludes the third capacitative storage means, second inductive means, and fourth capacitative storage means according to whether the output voltage was below a first value or above a second value, respectively, so that the pulse generator is capable of altering the power of at least one following pulse hence becoming capable of at least partially maintaining the effectiveness of the generator under conditions of varying loads, while substantially retaining the height of the substantially unipolar profile.

4. An electric fence energiser containing a pulse generator as claimed in claim 1 or as claimed in claim 3.

5. An electric fence energiser as claimed in claim 4, further comprising a converter for accepting a low-voltage DC input and for being switched on or off by means of a connected control line so that a voltage across the first capacitative storage means is capable of being held at a desired predetermined level.

6. An electric fence energiser as claimed in claim 4, further comprising a user-accessible switching means for selecting one of the power modes.

7. An electric fence energiser as claimed in claim 4, wherein one of said power modes is an automatic mode in which an operating mode is automatically selected.

8. An electric fence energiser as claimed in claim 4, wherein said means for sensing the output voltage includes a sense winding within the output transformer; the sense winding being electrically coupled to an evaluation means which evaluation means is provided with one or more output control means for effecting connection or disconnection of the third capacitative storage means, second inductive means, and fourth capacitative storage means.

9. An electric fence energiser as claimed in claim 8, wherein the evaluation means includes a microprocessor having stored memory means and means for assessing at least one analog input and means for activating or deactivating one or more output control lines.

10. An electric fence energiser as claimed in claim 9, further comprising means for controlling the predetermined voltage across the first capacitative storage means which controls the magnitude of the separated pulses.

11. An electric fence energiser as claimed in claim 10, further comprising means for predicting a capacitor charging time to delay the onset of charging until a moment which will result in a full charge being available shortly before the release of the separated pulses.

12. In an electric fence pulse generator that comprises a circuit which produces a series of separated pulses that each has a substantially unipolar pulse shape by transferring electrical energy from a first capacitor through a first inductor to a second capacitor that is in parallel with a primary winding of an output transformer, the separated pulses being provided from a secondary winding of the output transformer, the pulse generator having means for charging the first capacitor to a predetermined voltage, the improvement comprising:

a control switch that selects a power mode of the pulse generator from among plural selectable power modes;

a third capacitor and a first switch that selectively connects said third capacitor in parallel with the first capacitor;

a second inductor and a second switch that selectively connects said second inductor in parallel with the first inductor; and a fourth capacitor and a third switch that selectively connects said fourth capacitor in parallel with the second capacitor;

said control switch being operably connected to said first, second, and third switches to control inclusion and exclusion of said first and second capacitors and said second inductor from the circuit and thereby select one of the plural power modes.

13. The improvement of claim 12, wherein said control switch comprises plural pairs of a light emitting diode and a light receiver aligned therewith, and a light gate that is manually movably between selected ones of said pairs to select one of the plural power modes.

14. The improvement of claim 13, wherein said light gate is annular and rotatable, and comprises open sectors which do not block light and closed sectors which block light.

* * * * *